United States Patent [19]

Satoh

[11] Patent Number: 4,861,081

[45] Date of Patent: Aug. 29, 1989

[54] APPARATUS FOR CONNECTING A HANDLE AND A LOCKING DEVICE ON AUTOMOTIVE DOORS

[75] Inventor: Seiki Satoh, Utsunomiya, Japan

[73] Assignee: Mitsui Kinzoku Kogyo Kabushiki Kaisha, Tokyo, Japan

[21] Appl. No.: 255,583

[22] Filed: Oct. 11, 1988

[30] Foreign Application Priority Data

Oct. 24, 1987 [JP] Japan ..... 62-162913

[51] Int. Cl.[4] ..... E05C 21/00

[52] U.S. Cl. ..... 292/336.3; 411/437; 292/DIG. 53

[58] Field of Search ..... 292/216, 280, 336.3, 292/DIG. 53, 196, 223, 123, 347; 403/70, 163; 411/437, 324, 433

[56] References Cited

U.S. PATENT DOCUMENTS

| | | | |
|---|---|---|---|
| 3,878,757 | 4/1975 | Puklus, Jr. | 411/433 |
| 4,124,320 | 11/1978 | Rapata | 403/163 |
| 4,381,656 | 5/1983 | Hayakawa | 292/DIG. 53 X |
| 4,478,445 | 10/1984 | Shimiyu | 292/336.3 |
| 4,591,196 | 5/1986 | Kurita | 292/336.3 |
| 4,796,934 | 1/1989 | Kesel et al. | 292/216 X |

FOREIGN PATENT DOCUMENTS

| | | | |
|---|---|---|---|
| 52-12055 | 3/1977 | Japan . | |
| 60-180813 | 11/1985 | Japan . | |
| 571662 | 1/1976 | Switzerland | 411/433 |

*Primary Examiner*—Richard E. Moore

*Attorney, Agent, or Firm*—Browdy and Neimark

[57] ABSTRACT

In the connecting apparatus of this invention for coupling the handle and the locking device, the connector rotatably mounted on the handle or the locking device has a pair of oppositely directed hooks with a gap therebetween. The hooks have a first raised or recessed surface such as threaded grooves on their inner surfaces. The rod has formed on one end a second raised or recessed surface for engagement with the first raised or recessed surface on the hooks. These raised or recessed surfaces of the hooks and the rod can easily be engaged by first putting the second raised or recessed surface of the rod in the gap of the connector and turning the connector by 90°.

1 Claim, 3 Drawing Sheets

APPARATUS FOR CONNECTING A HANDLE AND A LOCKING DEVICE ON AUTOMOTIVE DOORS

DESCRIPTION

1. FIELD OF THE INVENTION

This invention relates to a connecting apparatus of handle and locking device for automotive doors.

2. PRIOR ART

The doors of automobiles generally have a locking device with a latch for engagement with a striker that is mounted on the car body, and an outer handle and an inner handle that release the engagement between the latch and the striker.

Generally, the locking device and the handle are connected through a rod. Both ends of the rod are bent at right angles and the bent portions are inserted into holes formed in the locking device and the handle. In this conventional structure, a slight difference between the distance from the locking device to the handle and the length of the rod makes the connection difficult.

In the light of this drawback, the Japanese Utility Model Laid-Open No. 180813/1985 proposes a rod holder that can connect the rod to the handle even when there are some variations in the rod length. This rod holder has a leg to be inserted into a hole in the handle and a ring retainer with threaded grooves formed on the inner surface. The holder is connected by engaging the threaded ring retainer with the threaded portion formed at the end of the rod and inserting the leg into the hole of the handle.

The rod holder, however, has a disadvantage that the adjustment of the rod length is made by rotating the holder with respect to the rod and is therefore not easy because the holder must be rotated while aligning the positions of the leg and the hole.

Another rod holder is proposed by the Japanese Utility Model Laid-Open No. 12055/1977 which enables easy connection of the lengthwise intermediate portion of the rod to a fixed panel. This rod holder has a pair of symmetrically arranged hooks and a rectangular leg. The rod holder is coupled by inserting the leg into a square hole in the fixed panel, disposing the rod perpendicular to and between the symmetrical hooks, and turning the rod 90° to engage the rod with the inner surfaces of the hooks.

This rod holder, however, is not designed to adjust the length of the rod and, in addition, has a disadvantage that since the rod itself is turned, the rod holder cannot be used in a small inner space of the door.

OBJECT OF THE INVENTION

The object of the invention is to provide a connecting apparatus which enables easy and correct connection between the locking device and the handle (or similar parts) through a rod even when there are positional deviations between the locking device and the handle.

DETAILED DESCRIPTION OF THE INVENTION

Figure 1:
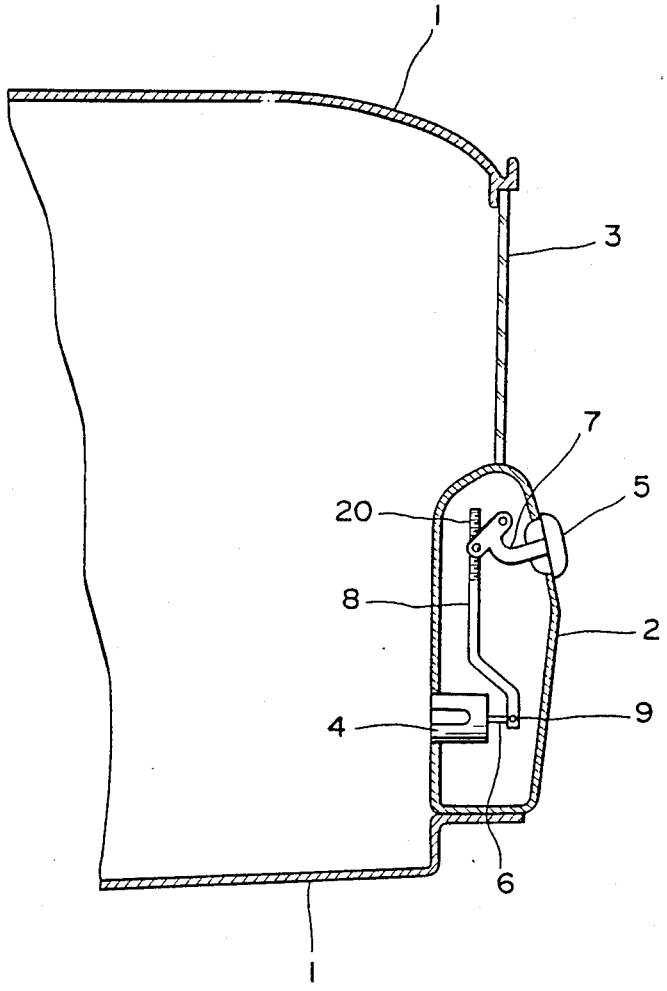
FIG. 1 is a cross section showing the outline of a locking device and a handle, both mounted to the door of a car.

One embodiment of the invention will now be explained by referring to the attached drawings. On a door 2 of the car body 1 are mounted a locking device 4 which has a latch (not shown) to engage with a striker (not shown) installed on the car body 1, and a handle 5. Though not shown, the locking device 4 has an open lever that rotates the latch, and a projection 6 that projects from the open lever. The handle 5 has a lever 7 that is pivoted when the door is opened. Reference numeral 3 denotes a window glass.

The lower end of a rod 8 is rotatably supported by a shaft 9 on the projection 6. The upper part of the rod 8 is formed with a threaded portion 20.

A connector 10 for adjusting the length of the rod 8 has a pair of oppositely directed hooks 11, 12 with a gap 13 therebetween and also has an insertion shaft 16 provided at its central undersurface. The hooks 11, 12 have threaded grooves 14, 15 formed on their inner surfaces. The insertion shaft 16 has an annular edge 17 formed at the end to prevent it from getting out of its position.

The lever 7 has mounted at its end a synthetic resin flange 18 that has a hole 19 through which the insertion shaft 16 is rotatably inserted.

Now, we will explain the procedure for connecting the rod 8 to the lever 7 by means of the connector 10. First, the locking device 4 is rigidly installed at the lower part of the door 2; the handle 5 is fixed at the upper part of the door; the lower end of the rod 8 is rotatably supported on the projection 6 of the locking device 4 by the shaft 9; and the insertion shaft 16 of the connector 10 is inserted into the hole 19 of the flange 18 of the lever 7.

Figure 2:
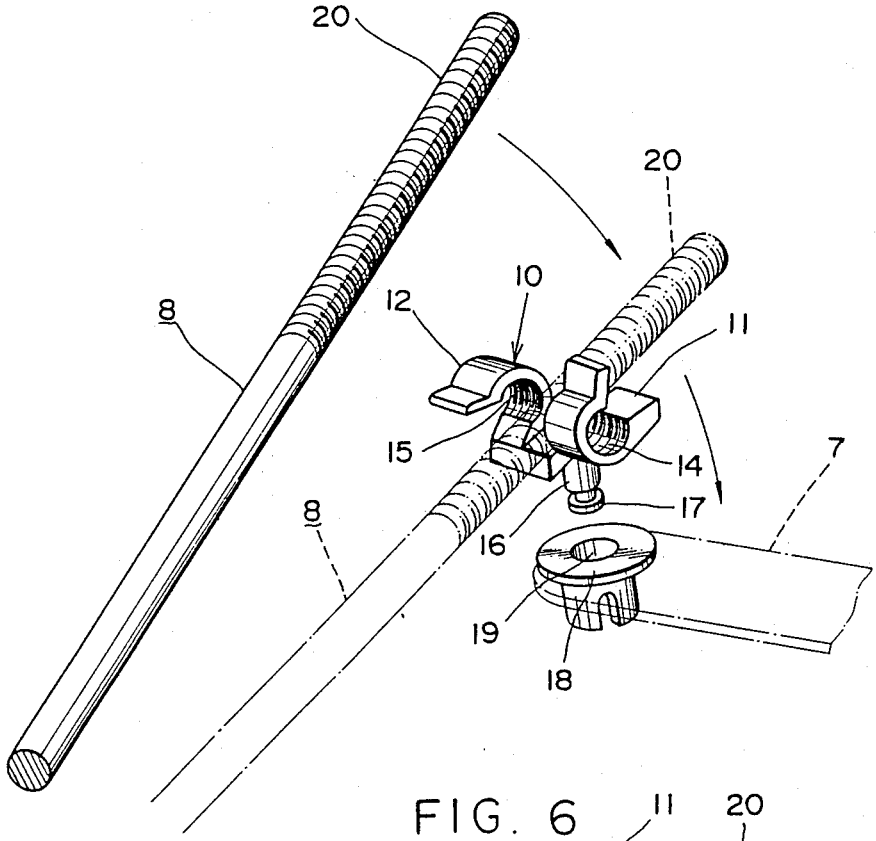
FIG. 2 is a perspective view of a rod and a connector.
Figure 6:
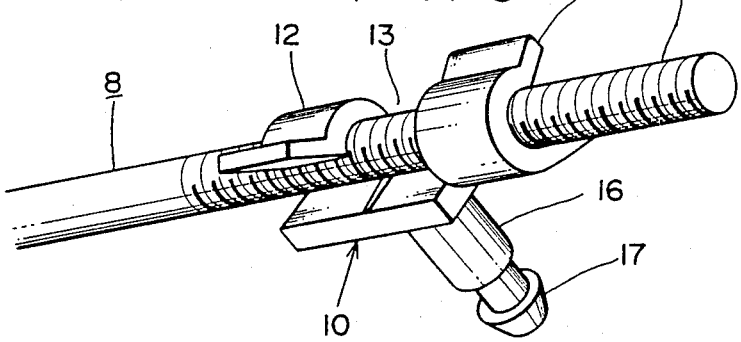
FIG. 6 is a perspective view showing the connector mounted on the rod.
Figure 3:
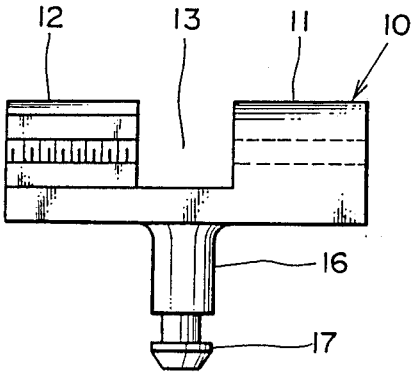
FIG. 3 is an elevational view of the connector.
Figure 5:
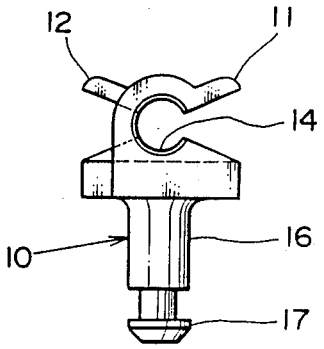
FIG. 5 is a side view of the connector.
Figure 4:
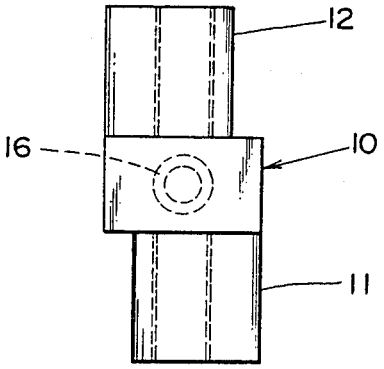
FIG. 4 is a plan view of the connector.

Then, the connector 10 is disposed perpendicular to the rod 8 and, as shown in FIG. 2, the threaded portion 20 of the rod 8 is put in the gap 13 of the connector 10. While keeping this relative positional relationship between the rod 8 and the level 7, the connector 10 is turned 90° about the shaft 16 so that the hooks 11, 12 engage with the threaded portion 20 of the rod 8 as shown in FIG. 6. Now, the rod 8 is connected to the lever 7. In this way, any kind of rod, as long as it is longer than the distance between the handle 5 and the locking device 4, can be coupled to the lever 7 by simplying turning the connector 10 by 90°.

Since in this condition the threaded grooves 14, 15 formed in the hooks 11, 12 of the connector 10 are engaged with the threaded portion 20 of the rod 8, the connecting position of the lever 7 on the rod 8 will not be shifted even when the handle 5 is operated.

The threaded portion 20 of the rod 8 and the threaded grooves 14, 15 of the hooks 11, 12 are not necessarily formed with threads and instead may be formed with simple raised and recessed surfaces as long as they provide a secure engagement.

ADVANTAGE

As described above, the invention allows easy and correct coupling to the handle of the rod which is installed in a small space such as an inner space in the door, without being affected by the distance between the locking device and the handle.

I claim:

1. An apparatus for connecting a handle and a locking device on automotive doors, comprising:

a locking device mounted on the door, the locking device having a latch to engage with a striker mounted on the car body;

a handle mounted on the door for releasing the engagement between the latch and the striker;

a rod for connecting the handle and the locking device, the rod having at one part a second raised or recessed surface that engages with a first raised or recessed surface; and a connector rotatably mounted on the handle or the locking device, the connector having a pair of oppositely directed hooks with a gap therebetween, the hooks having on their inner surfaces the first raised or recessed surface such as threaded grooves;

whereby the second raised or recessed surface of the rod is put in the gap of the connector and the connector is turned 90° to engage the second raised or recessed surface of the rod with the inner surface of the hooks of the connector.

* * * * *